US005347688A

United States Patent [19]

Ross

[11] Patent Number: 5,347,688

[45] Date of Patent: Sep. 20, 1994

[54] CLOTHING FASTENER APPARATUS

[76] Inventor: James M. Ross, Rt. 3, Box 670, Brenham, Tex. 77833

[21] Appl. No.: 125,027

[22] Filed: Sep. 21, 1993

[51] Int. Cl.[5] ..... A47G 25/00

[52] U.S. Cl. ..... 24/40; 24/429; 7/123

[58] Field of Search ..... 24/40, 41, 45, 546, 24/455, 419, 429; 294/3.6, 33; 296/26; 7/123, 169

[56] References Cited

U.S. PATENT DOCUMENTS

| | | | |
|---|---|---|---|
| 240,632 | 4/1881 | Adamson | 24/40 |
| 322,284 | 7/1885 | Havell | 24/40 |
| 349,415 | 9/1886 | Taylor | 24/40 |
| 1,084,399 | 1/1914 | Collins | 24/40 |
| 2,663,588 | 12/1953 | Scheldorfer | 294/3.6 |
| 2,928,157 | 3/1960 | Deering | 294/3.6 |
| 4,942,646 | 7/1990 | Sebastian | 24/40 |
| 5,008,985 | 4/1991 | Thompson | 24/429 |

FOREIGN PATENT DOCUMENTS

| | | | |
|---|---|---|---|
| 0009641 | 8/1908 | United Kingdom | 24/40 |

*Primary Examiner*—Victor N. Sakran

*Attorney, Agent, or Firm*—Pravel, Hewitt, Kimball & Krieger

[57] ABSTRACT

An apparatus provides ease in fastening clothing which has buttons or studs. The apparatus is particularly suited for fastening slacks or jeans which are worn to be tight-fitting or form-fitting. It is also helpful for people with limited manual dexterity, whether from illness or injury.

6 Claims, 2 Drawing Sheets

CLOTHING FASTENER APPARATUS

BACKGROUND OF THE INVENTION

1. Field of the Invention

The present invention relates to fasteners used for clothing.

2. Description of the Prior Art

There are situations where a task considered routine by most, such as buttoning a garment, can be quite difficult. Fastening clothing for people with limited dexterity in their hands due to disability, illness or injury is one such situation. Also, there are certain types of clothing which are worn tightly fitted or form fitted. A common example is western jeans or slacks, which are often heavily starched. This type of clothing as well as other pants or slacks are typically fastened on the wearer by a button or stud at the waistline and closed with a zipper. Often a wearer finds it quite difficult to fasten the belt or waist band of pants or slacks of this type without assistance. Further, even once the belt or waist band is buttoned, closing the zipper is another problem. When the wearer has long fingernails, particularly artificial ones, a further problem is the possibility of breaking a fingernail in putting on these types of clothing.

SUMMARY OF INVENTION

Briefly, the present invention provides a new and improved apparatus for fastening a garment having a button and buttonhole on the body of the wearer. The apparatus of the present invention includes a nose member for fitting into the buttonhole of the garment. A collar member portion of the apparatus is formed rearward of the nose member to fit over the button and connect with the button. A neck portion connects the collar member and the nose member. The neck member has spaced guide members which are adapted to fit between the button and the garment. A gripping shaft or stem of the apparatus extends from the collar member. The gripping shaft is gripped by an individual to manipulate the apparatus in fastening the garment.

The individual, who is usually the wearer, grips the apparatus by the gripping shaft and inserts the nose member into the buttonhole of the garment. The apparatus is then moved until the collar member is located with the button. The collar member is then fitted over the button and the apparatus moved so that the spaced guide members urge the button stem into a recess behind the nose member. The apparatus is then moved to pull the button through the buttonhole and fasten the garment. The apparatus also includes a hook for engaging the pull tongue or tab on a zipper of the garment. Thus, once the button is fastened, the zipper may also be easily closed by the apparatus of the present invention.

DETAILED DESCRIPTION OF THE DRAWINGS

Figure 1:
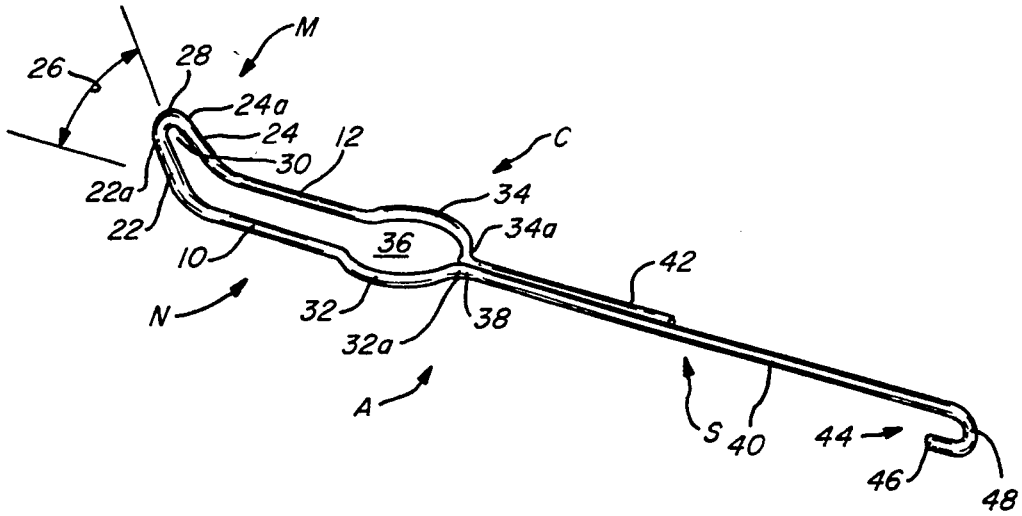

FIG. 1 is an isometric view of a clothing fastener apparatus according to the present invention.

Figure 2:
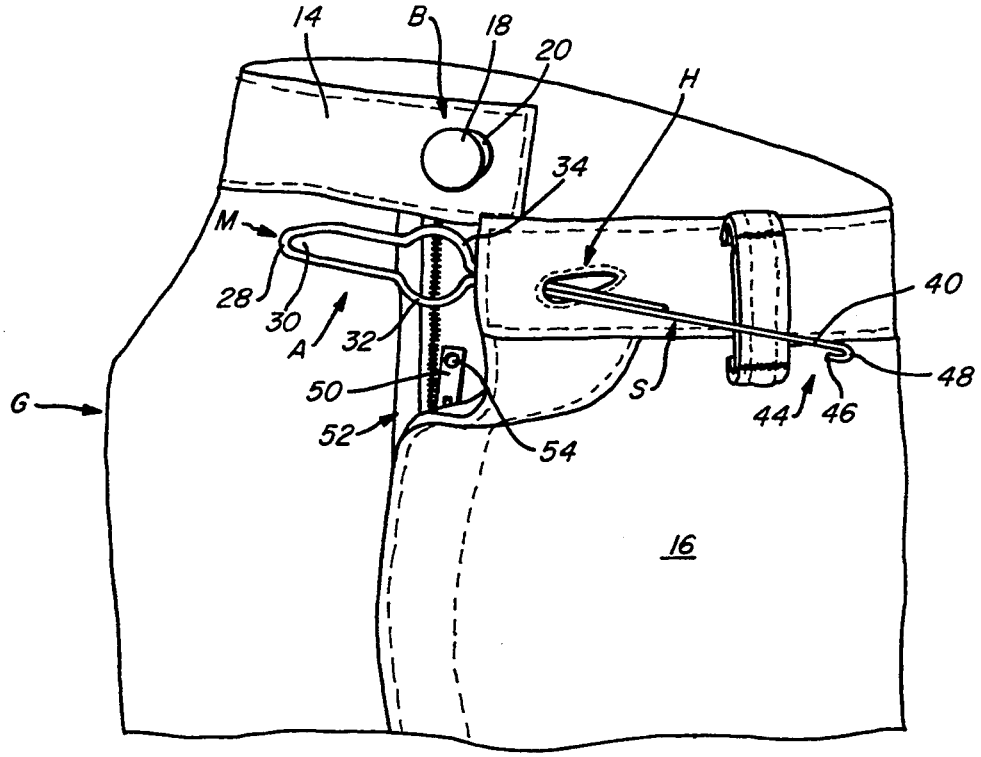
Figure 3:
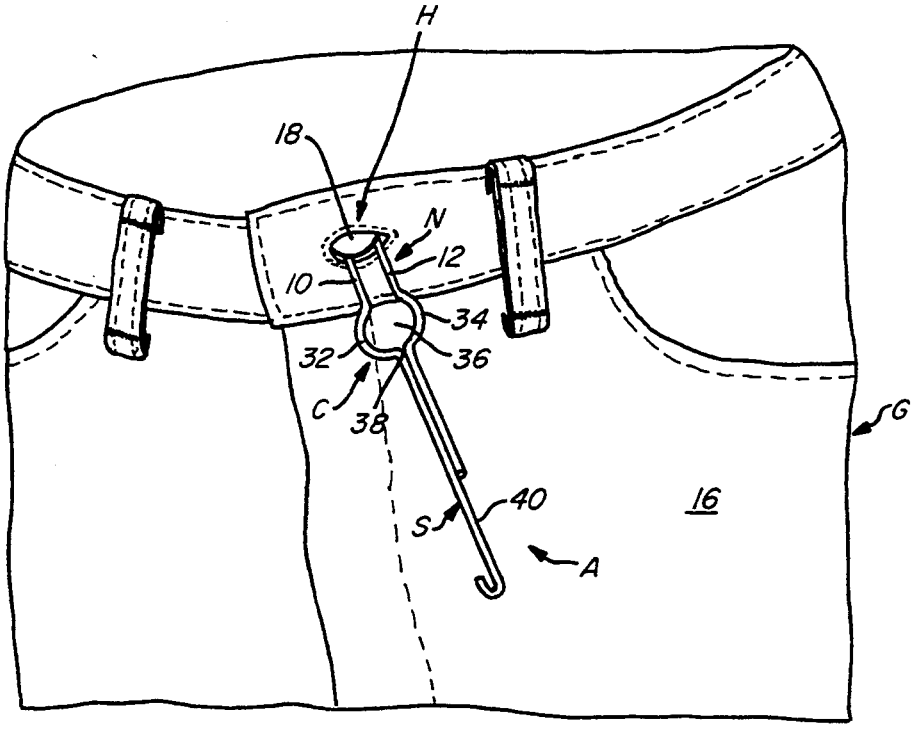
Figure 4:
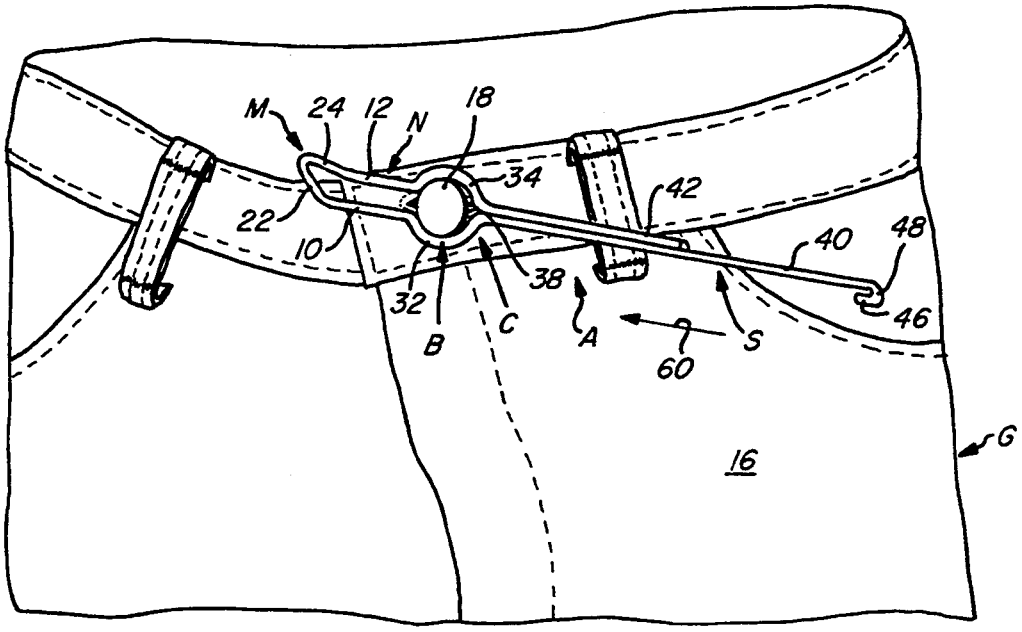

FIGS. 2, 3, and 4 are isometric views of the apparatus of FIG. 1 illustrating its use.

DESCRIPTION OF THE PREFERRED EMBODIMENT

In the drawings, the letter A designates generally an apparatus for fastening a garment G which has a button or stud B and a buttonhole H. The apparatus A is used to fit over the button B and guide it through the buttonhole H to fasten the garment G.

The apparatus A according to the present invention includes a nose member M for fitting into the buttonhole H. A collar member C is formed rearwardly of the nose member M on the apparatus A to fit over and connect with the button B. A neck portion N of the apparatus A is formed connecting the collar member C and the nose member M. The neck portion N has spaced guide members 10 and 12 for fitting between the button B and the garment G. The apparatus A also includes a gripping shaft S which is adapted to be gripped by an individual, whether a wearer of the garment G or other user, to manipulate the apparatus A and fasten the garment G. Preferably, the apparatus A is stamped or otherwise formed as a unitary structure of a suitable material, such as stainless steel. It should be understood that other materials and forming techniques may be used, if desired.

In the embodiment shown in the drawings, the button B and the buttonhole H are shown on a waistband portion 14 of slacks or jeans 16. It should be understood, however, that the apparatus A may also be used to fasten buttons and buttonholes on other locations and types of garments. The button B is shown as having a unitary head portion 18 and connecting stem 20 which are stamped or otherwise fixedly mounted on the garment, as is common on jeans. The apparatus A may also be used, if desired, on buttons which are sewn or otherwise attached to the garment G.

The nose member M of the apparatus A includes first and second leg member 22 and 24, respectively, each extending upwardly from an associated one of the spaced guide members 10 and 12 of the neck portion N. The nose member M thus extends upwardly from the neck portion N at an angle 26, usually 30° to 60°, to allow ease of insertion and entry of the apparatus A into the buttonhole H (FIG. 2) and for ease in fastening operations.

The leg members 22 and 24 of the nose member M converge toward each other over their upward extent from the spaced guide members 10 and 12 to enter end portions 22*a* and 24*a*, respectively. A rounded nose portion 28 is formed connecting the inner end portions 22*a* and 24*a* of the nose member M. The nose portion 28 and the inner end portions 22*a* and 24*a* form a receiving notch area 30 at the juncture of the leg members 22 and 24. The receiving notch 30 is adapted to receive and engage the stem 20 of the button B during use of the apparatus A, as will be set forth below.

The spaced guide members 10 and 12 of the neck portion N are located parallel to each other and spaced from each other a suitable distance, usually one-quarter inch or more. The spaced guide members 10 and 12 serve as confining or guide rails (FIG. 3) to move along the stem 20 of the button B as the apparatus A is moved to move the button B from the collar member C toward the receiving notch 30 adjacent the nose member M.

The collar member C is in the form of a pair of curved lips or arcuate rails 32 and 34, each extending outwardly from one of the guide members 10 and 12, respectively, of the neck portion N. The curved lip portions 32 and 34 of the collar member C define a generally circular button passage 36 within the collar member C. The diametric spacing of the curved lip members 32 and 34 is a suitable distance for ease of passage over the head portion 18 of the button B (FIG.

4). A typical spacing is on the order of three-quarter inch inner diameter for the button passage 36.

The curved lip portions 32 and 34 of the collar member C converge towards each other at their end portions 32*a* and 34*a*, respectively, opposite the guide members 10 and 12. The curved lip portions 32 and 34 thus form a juncture 38 with the gripping shaft S at their end portions 32*a* and 34*a*. The gripping shaft S is formed of an elongate stem rod or shaft 40. The stem rod 40 is adapted to be gripped by a user or wearer to permit manipulation and use of the apparatus A. A second stem rod or shaft 42 is formed extendingly parallel and adjacent to the rod 40 along at least a portion of its length. The second stem rod or shaft 42 is in contact with the shaft 40 along its length. The second stem or rod 42 provides greater strength to the gripping shaft S and structural integrity to the juncture 38 forming a closure of the button passage 36. Preferably, the stem rods 40 and 42 are welded, glued or otherwise suitably fused to each other along their length.

The apparatus A also includes a hook member 44 formed on either one or both of the stem rods 40 and 42 of the gripping shaft S. The hook member 44 includes a reverse extending hook arm 46 formed at an end of an arcuate or curved outer end 48 of the gripping shaft S. The hook member 44 is adapted to engage a pull tongue 50 (FIG. 2) of a zipper 52 of the garment G. The hook arm 46 is inserted into an eyelet or opening 54 in the pull tongue 50 of the zipper 52. The apparatus A may then be manipulated so that the pull tongue 50 is fitted within the hook arm 46. The zipper 52 can then be easily pulled closed with the apparatus A. The apparatus A can also equally as well be used to unzip the zipper 52 in a similar manner.

In the operation of the present invention, the individual, who is usually the wearer, grips the apparatus A by the gripping shaft S. The nose member M is then inserted into the buttonhole H of the garment G. The apparatus is then moved through the buttonhole H, with the collar member C passing through the buttonhole H (FIG. 2). The apparatus A is then moved to a position so that the collar member C is located to fit over the button 18. The collar member is then fitted over the button 18. The apparatus A is then partially retracted through the buttonhole H. During such movement (FIG. 3), the spaced guide members 10 and 12 which connect the nose member M and collar C urge the button stem 20 into the recess 30 behind the nose member 28.

The apparatus A is then further retracted through the buttonhole H, pulling the button B through the buttonhole H fastening the garment. When the button B passes through the buttonhole H, the apparatus A is then rotated at least one 360° rotation with the button stem 20 engaged in the receiving notch 30. The arm members 22 and 24 depress the fabric of the garment G adjacent the buttonhole H past the buttonhead 18 to insure that the button is properly fastened. The angular disposition of nose member M with respect to the remainder of the apparatus A eases such rotary movement. The apparatus A is then again slid forward, as indicated by an arrow 60 (FIG. 4) until the button head 18 is within the collar member C. At this time, the apparatus A can be removed from the button B.

When the garment G has a zipper, the hook member 44 may then be attached into the eyelet 54 of the pull tongue 52. The zipper 50 may then be closed with the apparatus A.

The apparatus A may also be used to engage and open zippers, and to engage and remove buttons from buttonholes by reversing the foregoing sequence of steps. Accordingly, the apparatus A can be seen to ease the fastening of clothing which has buttons or studs. It is adapted for use with tight-fitting garments. It may also be used on other garment types by those who have limited manual dexterity.

The apparatus also includes a hook for engaging the pull tongue or tab on a zipper of the garment. Thus, once the button is fastened, the zipper may also be easily closed by the apparatus of the present invention.

Having described the invention above, various modifications of the techniques, procedures, material and equipment will be apparent to those in the art. It is intended that all such variations within the scope and spirit of the appended claims be embraced thereby.

I claim:

1. An apparatus for fastening a buttonhole and button having a unitary head portion and connecting stem on a waistband of a garment on the body of a wearer, comprising:

a nose member for fitting into the buttonhole of the garment, said nose member comprising:

a pair of leg members;

said leg members converging toward each other over their extent to inner end portions;

a nose portion connecting said inner end portions of said leg members;

said leg members and said nose portion being insertable into the buttonhole of the garment to allow connection with the button for fastening same;

said nose portion and said inner portions of said leg members of said nose member forming a notch for receiving and engaging the stem of the button;

a collar member rearward of said nose member for fitting over the button to connect with the button;

said collar member comprising a pair of diametrically spaced curved lip portions each extending outwardly at a first end and converging to a juncture with the other lip portion at an opposite end;

said curved lip portions being spaced from each other a distance defining a button passage to fit over the head portion of the button;

a neck portion connecting said collar member and said nose member and having spaced guide members for fitting between the button and the garment;

said leg members of said nose member each being formed extending upwardly from one of said spaced guide members of said neck portion;

said spaced guide members of said neck portion extending from said collar member at end portions opposite said nose member and urging the button stem between them for movement from said collar member to said leg members and notch in said nose member as the apparatus is retracted through the buttonhole in the garment;

said leg members of said neck portion contacting the garment around the buttonhole to depress the garment past the head portion of the buttonhole as the apparatus is rotated with respect to the button; and a pair of gripping shafts extending at a difficult length from said collar member for being gripped for initial retracting movement of the apparatus through the buttonhole to pull the button through the buttonhole, and subsequent rotation by an individual to rotate the apparatus with respect to the button and fasten the garment; and a hook is formed on one of said gripping shaft.

2. The apparatus of claim 1, wherein:

said spaced guide members are located parallel to each other.

3. The apparatus of claim 1, wherein:

said nose member, said collar member, said neck portion, and said gripping shaft are integrally formed together.

4. The apparatus of claim 1, wherein:

said gripping shaft is formed extending from said juncture of said lip portions of said collar member.

5. The apparatus of claim 1, wherein the garment has a zipper with a pull tongue, and further including:

said hook formed on the apparatus for engaging the zipper pull tongue.

6. The apparatus of claim 5, wherein:

said hook is formed on said gripping shaft at an opposite end of said gripping shaft from said collar member.

* * * * *